US005112392A

United States Patent [19]

Anderson et al.

[11] Patent Number: 5,112,392

[45] Date of Patent: May 12, 1992

[54] RECOVERY PROCESS FOR ELECTROLESS PLATING BATHS

[75] Inventors: Roger W. Anderson, Farragut; Wayne A. Neff, Knoxville, both of Tenn.

[73] Assignee: Martin Marietta Energy Systems, Inc., Oak Ridge, Tenn.

[21] Appl. No.: 719,201

[22] Filed: Jun. 21, 1991

[51] Int. Cl.[5] ..... B01D 15/04

[52] U.S. Cl. ..... 106/1.22; 106/1.27; 210/667; 210/670; 210/688; 210/726; 210/912

[58] Field of Search ..... 210/667, 670, 681, 688, 210/726, 912; 106/1.22, 1.27

[56] References Cited

U.S. PATENT DOCUMENTS

| | | | |
|---|---|---|---|
| 4,009,101 | 2/1977 | Hayashi | 210/670 |
| 4,012,318 | 3/1977 | Hayashi | 210/670 |
| 4,076,618 | 2/1978 | Zeblisky | 210/670 |
| 4,303,704 | 12/1981 | Courduvelis et al. | 210/688 |
| 4,664,810 | 5/1987 | Matejka et al. | 210/684 |
| 4,666,683 | 5/1987 | Brown et al. | 210/670 |
| 4,770,788 | 9/1988 | Vignola | 210/670 |
| 4,789,484 | 12/1988 | Ying et al. | 210/726 |
| 4,863,612 | 9/1989 | Kirman et al. | 210/670 |
| 4,954,265 | 9/1990 | Greenberg et al. | 210/725 |
| 5,002,645 | 3/1991 | Eastland et al. | 210/688 |

*Primary Examiner*—Ivars Cintins

*Attorney, Agent, or Firm*—Herman L. Holsopple; Harold W. Adams

[57] ABSTRACT

A process for removing, from spent electroless metal plating bath solutions, accumulated byproducts and counter-ions that have deleterious effects on plating. The solution, or a portion thereof, is passed through a selected cation exchange resin bed in hydrogen form, the resin selected from strong acid cation exchangers and combinations of intermediate acid cation exchangers with strong acid cation exchangers. Sodium and nickel ions are sorbed in the selected cation exchanger, with little removal of other constituents. The remaining solution is subjected to sulfate removal through precipitation of calcium sulfate hemihydrate using, sequentially, CaO and then $CaCO_3$. Phosphite removal from the solution is accomplished by the addition of MgO to form magnesium phosphite trihydrate. The washed precipitates of these steps can be safely discarded in nontoxic land fills, or used in various chemical industries. Finally, any remaining solution can be concentrated, adjusted for pH, and be ready for reuse. The plating metal can be removed from the exchanger with sulfuric acid or with the filtrate from the magnesium phosphite precipitation forming a sulfate of the plating metal for reuse. The process is illustrated as applied to processing electroless nickel plating baths.

20 Claims, 7 Drawing Sheets

RECOVERY PROCESS FOR ELECTROLESS PLATING BATHS

The U.S. Government has rights in this invention pursuant to Contract No. DE-AC05-84OR21400 awarded by U.S. Department of Energy Contract with Martin Marietta Energy Systems, Inc.

DESCRIPTION

1. Technical Field

This invention relates generally to the processing of electroless plating baths and more particularly to a process for the recovery of the valuable bath constituents, such as the plating metal, reducing agents, complexing agents, etc., needed in electroless plating baths. The process also removes plating reaction by-products and other ingredients which have deleterious effects upon the plating process. These deleterious materials are removed and converted to non-hazardous forms. The process involving cation exchange and precipitation such that the valuable constituents of the bath can be recovered free from the deleterious concentrations of phosphite, orthophosphate, sulfate, sodium and other ions. If desired, the necessary bath constituents can be recycled to the bath after the recovery process.

2. Background Art

In the electroless plating art, objects are plated with a metal (without the application of electrical potentials) in order to produce a desired finish for improved appearance, for corrosion resistance and for many other desired results. Typical metals used in these plating processes are aluminum and certain of the transition metals and noble metals, such as copper, nickel, palladium, cobalt and gold. In most cases, the metal to be deposited conventionally exists in the bath as a sulfate; however, there are many other materials that make up the bath. These include, but are not limited to, sodium hypophosphite, sodium hydroxide, buffers and nickel complexing agents, various inhibitors, anti-pitting agents, etc. During the use of these baths the phosphite, sulfate and sodium concentrations increase to a point where plating rates decrease. Also, the rejection rate of the plated parts increases. As a result, the baths must either be replaced by fresh solutions, or the detrimental constituents must be removed to restore plating capacity.

Numerous processes have been developed in the prior art that are directed to the regeneration of the baths. For example, U. S. Pat. No. 4,425,205 issued to H. Honma, et al on Jan. 10, 1984, teaches that the plating metal is precipitated away from the chelating agent followed by precipitating the chelating agent, and then preparing materials for recycle using an anodic cell having an exchange membrane.

Other prior art processes are described in U.S. Pat. No. 4,303,704 issued to C. I. Courduvelis, et al on Dec. 1, 1981; U.S. Pat. No. 4,789,484 issued to W. Ying, et al on Dec. 6, 1988; U.S. Pat. No. 4,863,612 issued to L. E. Kirman, et al on Sept. 5, 1989, and U.S. Pat. No. 4,954,265 issued to B. Greenberg, et al on Sept. 4, 1990. The '704 patent describes the removal of complexed copper or nickel in electroless plating solutions by passage through a chelating resin. These ions are then removed from the resin using an acid solution, and can be recovered by precipitation with a hydroxide. In the '484 patent there is an initial precipitation of phosphite values, followed by oxidation of hypophosphite and remaining phosphite to phosphate, and a final removal of phosphate and nickel by lime precipitation. This coprecipitation is ineffective as at a pH of 10, nickel (which is considered a hazardous material) will be precipitated along with phosphite. There is no discussion of being able to recycle any of the values into a usable bath. The '612 patent discusses the processing of rinse water that exists in electroless nickel plating processes to produce deionized water for reuse. The valuable nickel is removed using a cation exchange media, with the water then being passed through a second cation exchanger and an anion exchanger to produce the deionized water. The '265 patent describes precipitating the active plating metal and its removal by filtration. The remaining feed liquid is an aqueous liquid suitable for discharge to a sewer line.

All of these prior art processes involve significant reconstituting of the bath prior to reuse. This minimizes an opportunity to efficiently process the electroless plating bath to remove the detrimental constituents thereof. Further, many of the materials being discharged to the environment from these processes are now considered to be hazardous. In many of the processes there is a significant loss of hypophosphite (one of the more expensive component of the bath) and the plating metal, nickel in particular.

Accordingly, it is an object of the present invention to provide a process for processing electroless plating baths to remove accumulated phosphite, sodium and sulfate without significant loss of the principal plating reagents.

It is another object to provide a process such that no discharge therefrom will be hazardous to the environment.

An additional object is to provide such a process as adapted for the processing of electroless nickel plating baths for the removal of deleterious materials, the recovery of the nickel, and for the return of the valuable constituents to the bath on a continuous or intermittent basis when desired.

A further object is to provide a process whereby the plating solutions can be recycled indefinitely without discharge of the bath liquid.

These and other objects of the present invention will become apparent upon a consideration of a complete description of the invention that follows when read in conjunction with the drawings.

DISCLOSURE OF THE INVENTION

In accordance with the present invention, at least a portion of an electroless plating bath is passed through an acid cation exchanger in hydrogen form to remove sodium cations and the cations of the plating metal. This acid cation exchanger is selected from strong acid exchangers and a combination of intermediate and strong acid cation exchangers. The effluent, with the sodium and plating metal cations primarily removed, is treated with a calcium salt to cause the precipitation of calcium sulfate hemihydrate which is removed by filtration. Magnesium phosphite trihydrate is then precipitated at reduced temperature and removed by filtration. The filtrate pH is adjusted to a target bath pH of about $4.5 \pm 0.1$ with sulfuric acid to prevent possible spontaneous reduction of nickelous ions to metallic nickel.

Recovered plating metal, hypophosphite or other reducing agent, complexing or chelating agents, stabilizer, anti-pit surfactant and decreased concentrations of phosphite, sulfate and sodium (and possibly magnesium with a trace of calcium) constitute the reusable bath composition. Additional amounts of bath constituents are added as needed to achieve the target bath concentrations. The recovered plating metal is obtained by removing sodium ions from the cation exchanger using a dilute sulfuric acid solution. The plating metal is then eluted using more concentrated sulfuric acid.

Alternatively, the plating metal can be removed by displacing the same with magnesium ions from magnesium sulfate or preferably with magnesium plus a small amount of calcium ions from the filtrate after pH adjustment. The filtrate contains the required anions for electroless plating plus stabilizer and surfactant. The column effluent, by the treatment with magnesium and calcium for displacement, will constitute the reusable plating bath with a decreased concentration of sodium ions just sufficient to supply the required cation equivalents for anions in solution. Magnesium ions sorbed on the resin, after displacement with magnesium sulfate, can be used to convert sodium hypophosphite to magnesium hypophosphite for bath feed if an electroless plating bath with magnesium cations is desired. The process is particularly described for the processing of electroless nickel plating baths.

BEST MODE FOR CARRYING OUT THE INVENTION

For platers, the best mode for carrying out the invention is to recycle electroless plating bath solutions through a treatment process as described below to maintain optimum concentrations of phosphite, sodium and sulfate to achieve optimum plate quality and plating rates.

Figure 1:
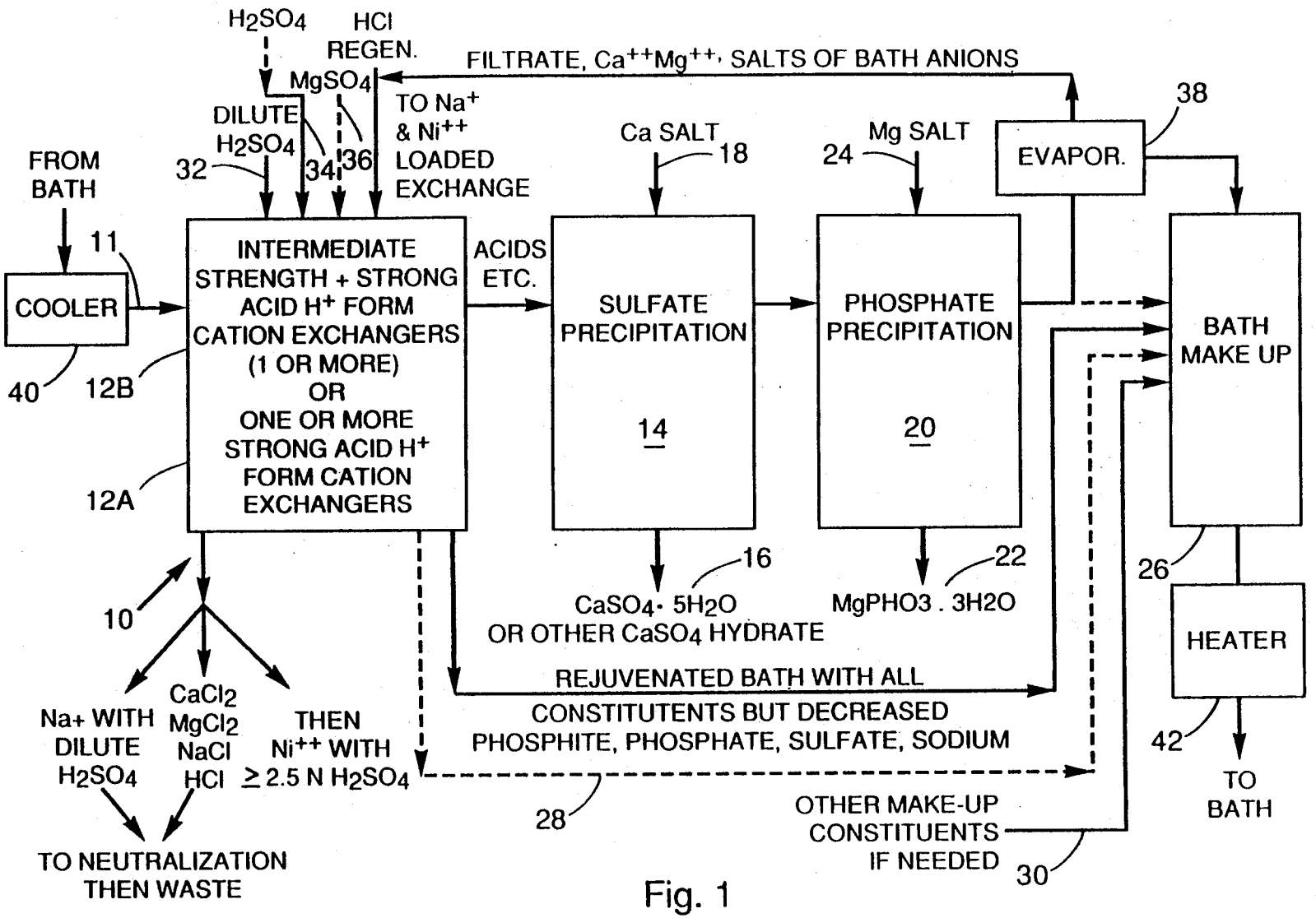
FIG. 1 is a general block diagram illustrating the basic steps of the present invention, together with some of the alternatives thereof. This figure, together with those that follow, are for the present process as utilized for electroless nickel plating baths.

The overall process of the present invention, as applied to electroless nickel plating, is illustrated at 10 in the block diagram of FIG. 1. As will be discussed in more detail hereinafter, certain alternatives of the process are included. The "spent" bath solution 11 enters a cation exchanger 12 where both nickel and sodium are sorbed very effectively. This exchanger can be a strong acid exchanger alone (12A) wherein both the Na and Ni are sorbed, or it can be (as at 12B) an intermediate acid exchanger to sorb the Ni followed by a strong acid exchanger for the sorption of the Na. As will be discussed below, the exchanger material(s) can be contained in a plurality of exchanger beds or units. The remaining bath constituents, after the removal of Na and Ni, then pass into a precipitator 14 wherein sulfate is precipitated as calcium sulfate hemihydrate (16) using a basic calcium salt (at 18) selected from CaO and $CaCO_3$ Although not illustrated, calcium hydroxide can also be used, although less effectively. A further step is carried out in another precipitator 20 where phosphite is precipitated as magnesium phosphite trihydrate (22) using a basic magnesium salt (24), such as MgO. Magnesium hydroxide can also be used. It will be recognized, however, that the basic calcium and/or magnesium salts would also include Dolomite or other mixtures of calcium and magnesium carbonates.

The remaining liquid then passes to a bath makeup unit 26 where the recovered nickel 28 can be added, together with any other makeup constituents 30.

As shown in this diagram, the sodium is eluted from the exchanger using dilute sulfuric acid (32) and the nickel is eluted using stronger sulfuric acid (34) or with magnesium sulfate (36). Some evaporation may be required since some of the constituents may have been diluted in various steps of the process, particularly in the washing of precipitates. This is illustrated at 38, although evaporation may be involved in all constituents being fed to the bath makeup unit 26.

Typically an electroless nickel bath is utilized at a temperature of about 95° C. In order that the solution, or a portion thereof, can be processed, that which is to be processed typically is cooled to near room temperature using a cooler 40. Then, after the solution is ready for reuse, it is typically reheated in heater 42. This cooling and heating can be accomplished with a countercurrent heat exchanger (see FIG. 3) or with other devices known to those versed in the art.

Figures 2A, 2B, 2C, 2D:
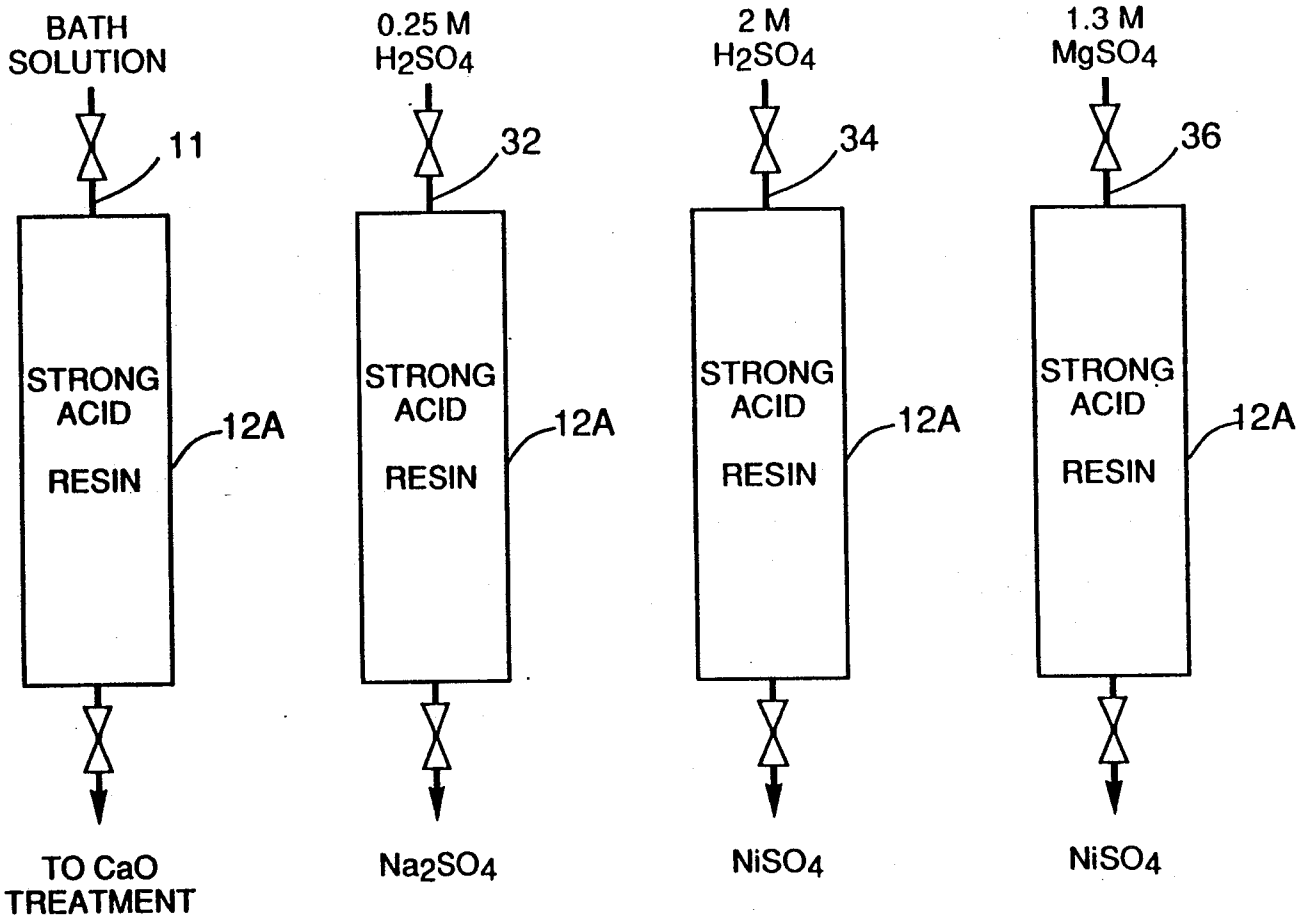
FIGS. 2A-2D are drawings illustrating the cation exchange flow diagrams of the present invention including removal of sodium and nickel cations on only a strong acid exchanger, and the individual elution of the same using two alternatives of the present process.

A schematic flow diagram for the operation of the strong acid cation exchange column 12A is shown in FIGS. 2A-2D . FIG. 2A represents the sorption of the sodium and nickel from the bath solution using a strong cation exchange medium in the acid form (with sulfonic acid functional groups). Typically this can be Amberlite IR120 available from Rohm and Haas, although there are many commercial strong acid cation exchangers known to those skilled in the art that would have the same characteristics. The sodium and nickel displace the hydrogen ion and thus are sorbed on the resin. A typical feed from an electroless nickel bath has a pH of about 4.5±0.1, a lead content of about 0.2 ppm, a hypophosphite concentration of about 0.22 mol/l, a phosphite content of about 1.2 mol/l, a nickel concentration of about 0.082 mol/l, a lactate concentration of about 0.48 mol/l, a sulfate content of about 1.3 mol/l, and a sodium concentration of about 4.2 mol/l. After changed to about 0.35 while the concentrations of all other constituents remains about the same except for almost complete removal of the nickel and the sodium. This effluent solution is passed to the calcium sulfate precipitation step in precipitator 14.

FIG. 2B depicts the stripping of the sodium from the cation exchanger 12A as sodium sulfate. This is accomplished using a dilute sulfuric acid solution (about 0.25 M). The product is a sodium sulfate solution with excess sulfuric acid. Essentially no nickel is eluted at these conditions.

Then in FIG. 2C is shown one of the variations of stripping of the nickel from the strong acid column 12A. In this variation, about a 2 M sulfuric acid solution is used such that the product is nickel sulfate that can be recovered or reused in the bath. Concentration (as by evaporation discussed above) of this nickel solution is normally required prior to bath makeup.

An alternate stripping of the nickel from the column 12A is illustrated in FIG. 2D. In this variation, about a 1.3 mol/l solution of magnesium sulfate is used. The magnesium displaces the nickel such that nickel sulfate is available for the bath. As in the other variation, the nickel solution is typically concentrated prior to reuse. This cation resin with sorbed magnesium ions can then be used to convert sodium hypophosphite feed to magnesium hypophosphite for bath feed if desired.

Figure 3:
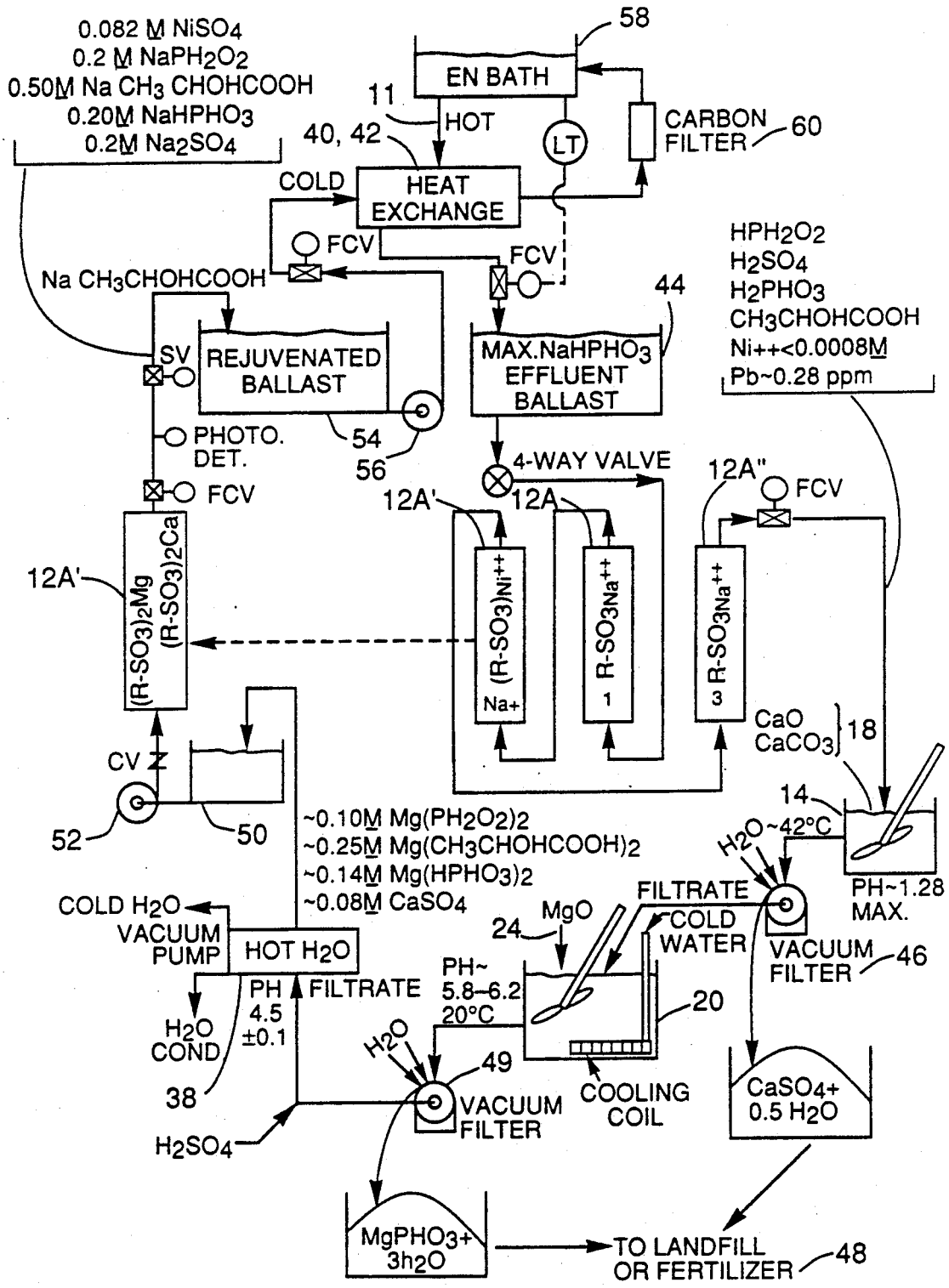
FIG. 3 is a flow diagram depicting in more detail all aspects of the present invention including a series of beds or units of strong acid cation exchanger for separating sodium cations from nickel cations in different locations in the exchanger beds.

A much more complete schematic drawing of the present process, in one embodiment, is in FIG. 3. As a practical matter, cooled spent bath is typically stored in a "ballast" or reservoir 44 so that there is always sufficient bath material for passing into the cation exchangers. Depicted in this flow diagram are three strong acid cation exchanger units, 12A, 12A' and 12A". The bath passing through unit 12A is substantially stripped of sodium. As the bath continues into unit 12A', the nickel is sorbed, typically in a narrow band therein. The remaining bath with significantly reduced Na and Ni then passes through unit 12A" prior to being fed into the precipitator 14.

As will be discussed in more detail regarding FIG. 4, both CaO and $CaCO_3$ are added sequentially, resulting in the precipitation of calcium sulfate hemihydrate. The precipitate is separated from the remaining liquid in, for example, a vacuum filter 46. After washing with water, the hemihydrate can be disposed of in a landfill or used in fertilizer as indicated at 48.

The filtrate after the calcium removal then goes to the second precipitator 20 where MgO is added for the precipitation of the magnesium trihydrate salt. As will be discussed hereinafter, this precipitation is accomplished at a lowered temperature. The precipitate is removed with a second filter 49 such that it, too, can be disposed of in a non-hazardous landfill or be used in fertilizer (48). The filtrate, after pH adjustment with sulfuric acid, passes through an evaporator (as item 38 of FIG. 1) and thence to a second buffer or reservoir 50. A pump 52 is typically used to transfer solution from the reservoir 50 up through the exchanger unit 12A' (using appropriate valves as illustrated in FIG. 6) where the nickel is displaced by any Mg and/or Ca. The effluent from the exchanger also contains most of the hypophosphite, lactate, or other chelating and buffering agents, anti-pit surfactant and lead inhibitor which were present in the bath before treatment Thus, this exchanger effluent (after possibly some concentration by evaporation) has substantially the correct composition for the electroless plating bath, and is stored in reservoir 54 until needed. It then is moved by pump 56 through the heat exchanger 40, 42 to the bath vessel 58. Preferably, this treated bath solution is passed through a filter 60 to remove any organics and solids that still might exist. Since the processing plant is isolated from the plating bath vessel by the reservoirs 44, 54, the processing can be continuous or can be conducted on a periodic schedule on a portion of the bath.

Figure 4:
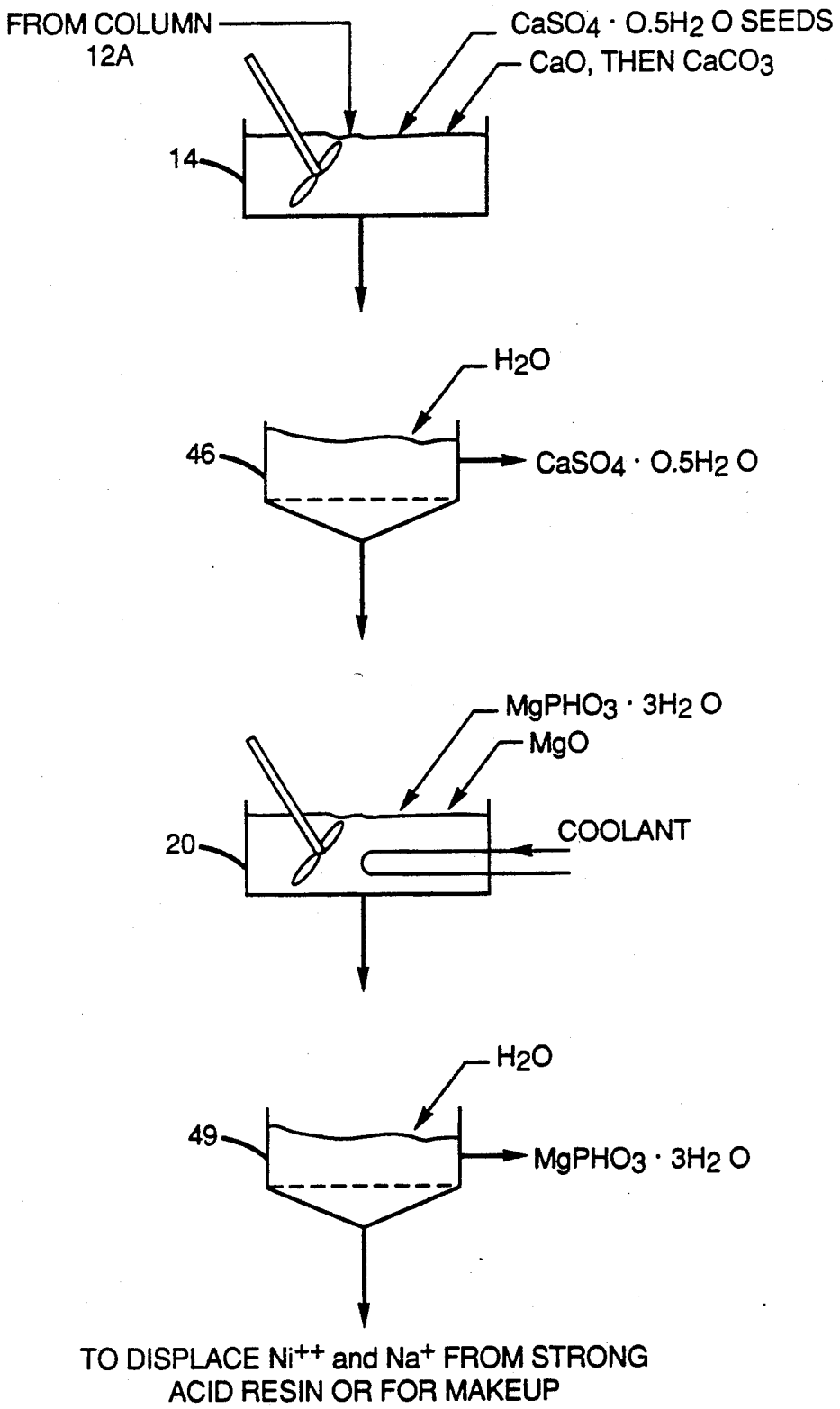
FIG. 4 is a drawing illustrating in greater detail the precipitation and filtration flow diagrams of the present invention as generally illustrated in FIGS. 1 and 3.

The precipitation and filtration steps of the present invention are illustrated in some more detail in FIG. 4. As indicated, the effluent from the cation exchanger 12A" (FIG. 2A and FIG. 3 )is first treated with CaO to alter the pH to about 0.9, with a temperature rise to about 42° C. This is followed by the addition of $CaCO_3$ to raise the pH to between 1.2 and 1.4. This second addition is used as it achieves better reaction under these conditions and prevents pH overshoot due to excess calcium reagent. Both of these basic calcium salts cause the precipitation of calcium sulfate hemihydrate which, after washing, can be placed in a land fill or used for other purposes. Precipitation is enhanced through the use of seed crystals of the hemihydrate.

Figure 5:
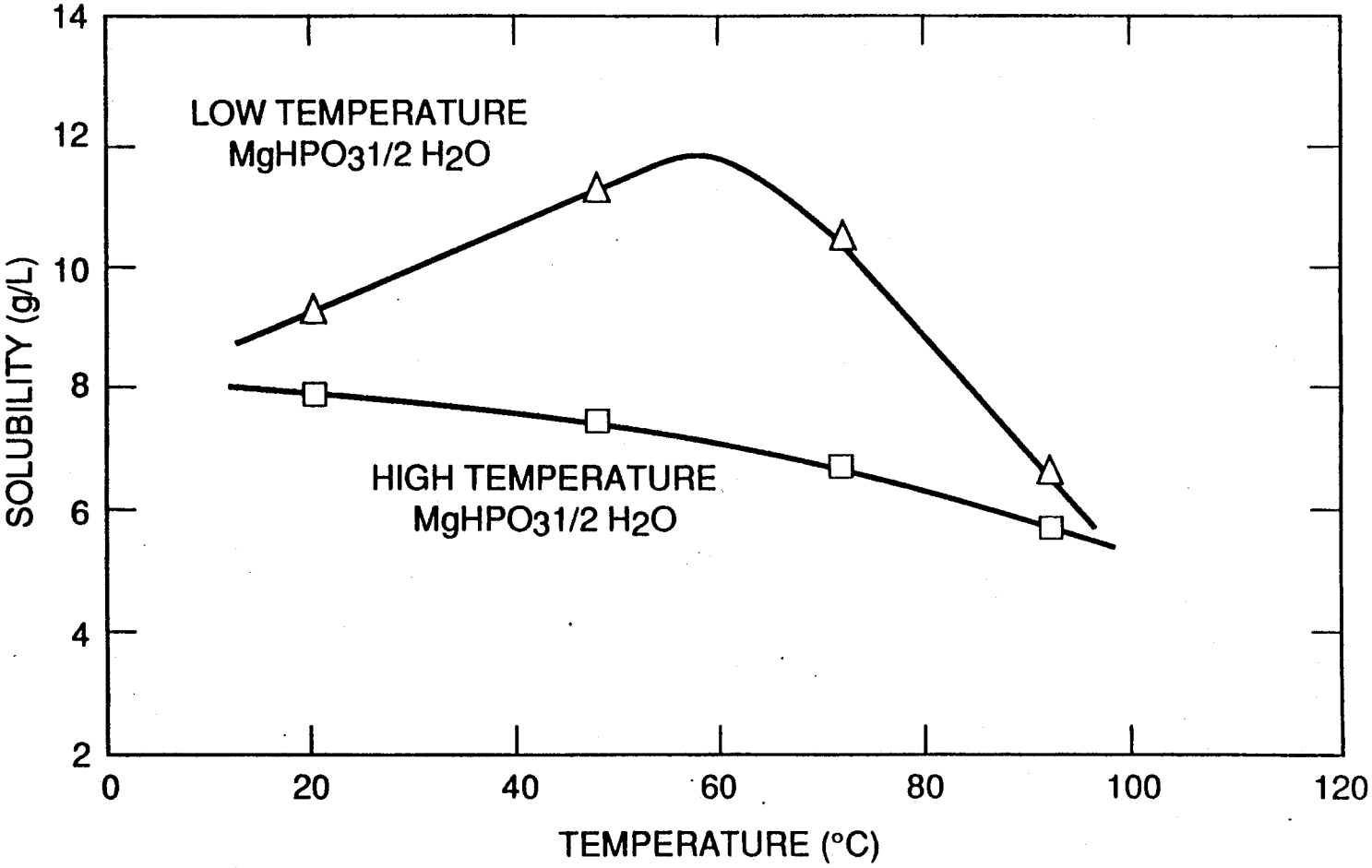
FIG. 5 is a graph illustrating the relative solubility of magnesium phosphites as a function of temperature.

The filtrate from the calcium sulfate hemihydrate precipitation is then treated with MgO (or magnesium hydroxide) to precipitate magnesium phosphite trihydrate. Although a monohydrate can be precipitated at bath temperatures, any nickel ions that are present may be occluded in the precipitate. Nickel metal can also spontaneously be formed at this higher temperature, thus causing a loss of nickel and hypophosphite that might be present. Accordingly, precipitation as the trihydrate at lower temperatures (about room temperature) avoids this possibility. The relative solubility is illustrated in FIG. 5.

Essentially no precipitation occurs until the pH exceeds about 4.5. Just prior to precipitation initiation, some seed crystals of the product are added to decrease occlusion of mother liquor and improve the filtration and washing characteristics of the solids. The MgO addition is continued until a stable pH of about 5.8 to 6.2 is achieved. When the temperature is maintained at about 20° C., the $MgPHO_3.3H_2O$ precipitates readily.

After washing, the precipitate can be disposed of to a land fill or, alternatively, to fertilizer production as indicated in FIG. 3. The filtrate is adjusted to the bath pH and evaporated to be used to displace nickel ions from the strong acid resin.

As discussed above, it is preferred that the cation exchanger be divided into several units. This facilitates the sorption of the nickel in a narrow band within one of the units while the bulk of the sodium is sorbed earlier in the exchanger. The distribution on the exchanger occurs because the sodium is essentially uncomplexed by sulfate and lactate in the bath solution, and the hydrogen ion concentration is not strong enough to prevent sodium sorption. On the other hand, the nickel is concentrated in a narrow band near the cation exchange front where the pH is sufficiently low to convert lactate to lactic acid and sulfate to hydrogen sulfate ions.

Figures 6A, 6B, 6C:
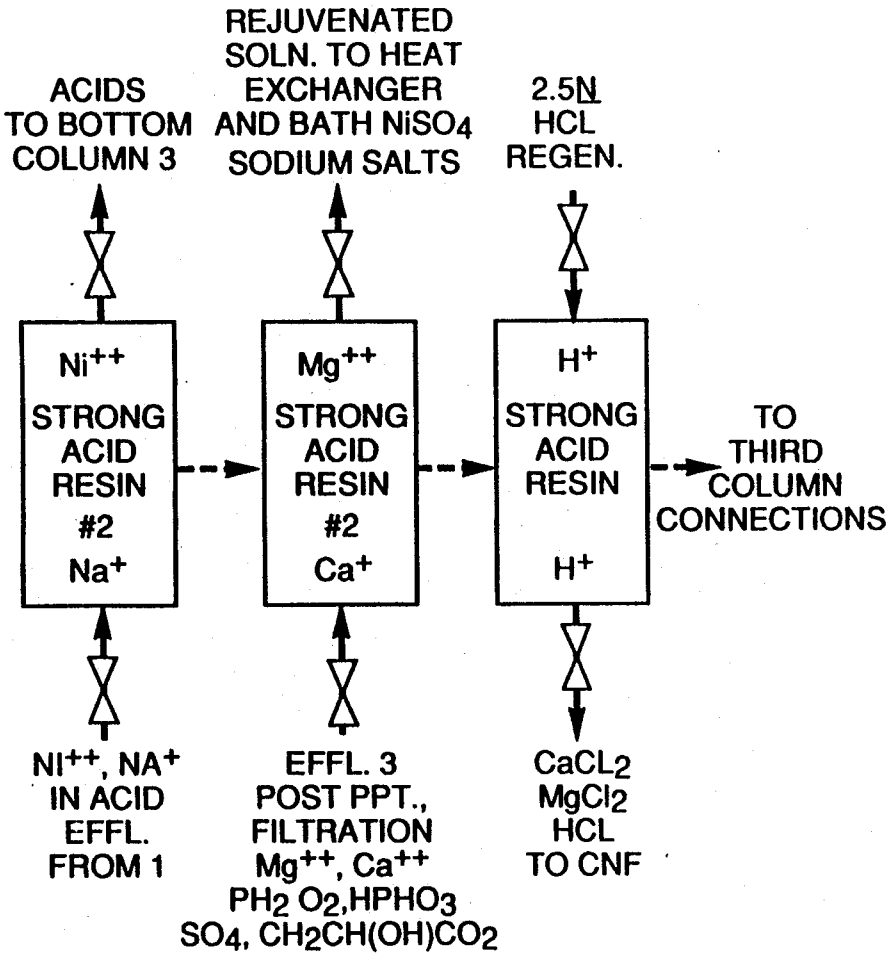
FIG. 6A through 6F are drawings depicting aspects of the removal of sodium and nickel cations from the strong acid exchanger units shown in FIG. 3.
Figures 6D, 6E, 6F:
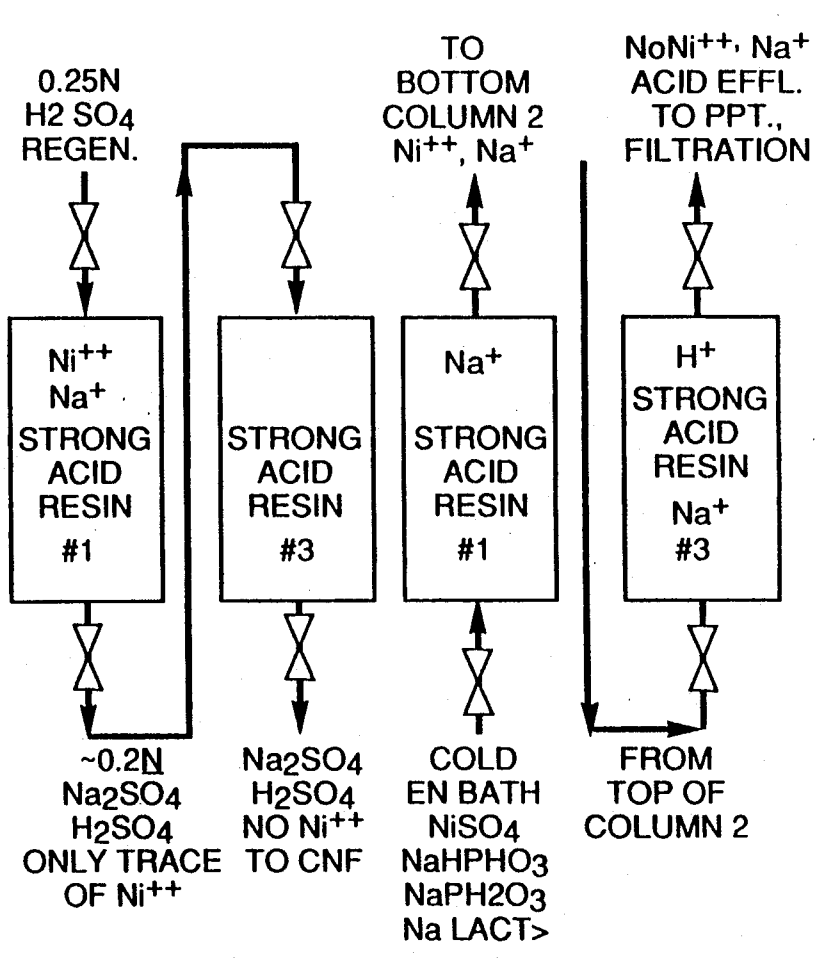

This multiple use of units also permits selective regeneration of the units. Such sorption and regeneration for strong acid exchangers are illustrated in FIG. 6 where the exchanger units are identified with the same designations as in FIG. 3. Thus, in FIG. 6E, the electroless bath enters the bottom of unit 12A and the sodium is primarily sorbed therein. In FIG. 6A, the effluent from unit 12A enters the bottom of unit 12A', and the nickel is primarily sorbed therein, with the effluent then being fed into the bottom of unit 12A" as indicated in FIG. 6F. The effluent from unit 12A" then goes to the precipitation steps as discussed above.

For the regeneration, sodium is removed from units 12A and 12A" by passing dilute sulfuric acid (typically 0.25 N at about 4cc/min/$cm^2$) downwardly through each in series as indicated in FIG. 6D. The effluent, being primarily acids, is sent to an appropriate central neutralization facility (CNF). The unit designated 12A', which contains the nickel, is regenerated in two steps as indicated in FIGS. 6B and 6C. First, the Mg-containing solutions derived from the precipitation steps is passed upwardly through the column as shown in FIG. 3. (A bath containing some Mg and Ca has been found to achieve satisfactory plating.) This removes the Ni which can be recovered or reused: the exchanger, however, is loaded with magnesium. The unit is then regenerated for its use in the nickel removal by passing an HCl solution (typically 2.5 N at about 1 cc/min/$cm^2$) down through the exchanger unit, with the effluent being directed to the CNF. Although not shown, alternatively nitric acid can be used for the final regeneration. This acid might be that commonly used to clean parts prior to plating. Thus, all three units are ready for reuse to process spent EN bath solutions.

Although strong acid exchangers have been found to adequately remove sodium and nickel from the electroless nickel baths (and other electroless plating baths), a greater separation of the two ions to thereby achieve better recovery of the nickel can be achieved by interposing an intermediate acid exchanger preceding the strong acid exchanger. Typical of such intermediate exchangers are phosphonate or aminophosphonate resins. One such resin is Duolite C-467 which is available from Rohm and Haas. This resin has $—CH_2—NH—CH_2—PO(ONa)_2$ functional groups attached to a cross-linked polystyrene skeleton. After treatment with a nonoxidizing acid, such as sulfuric or hydrochloric acid, and rinsing with water, the resin is converted to the phosphonic acid form. Preferably, the intermediate acid exchangers are used as two units.

Figures 7A, 7B, 7C, 7D:
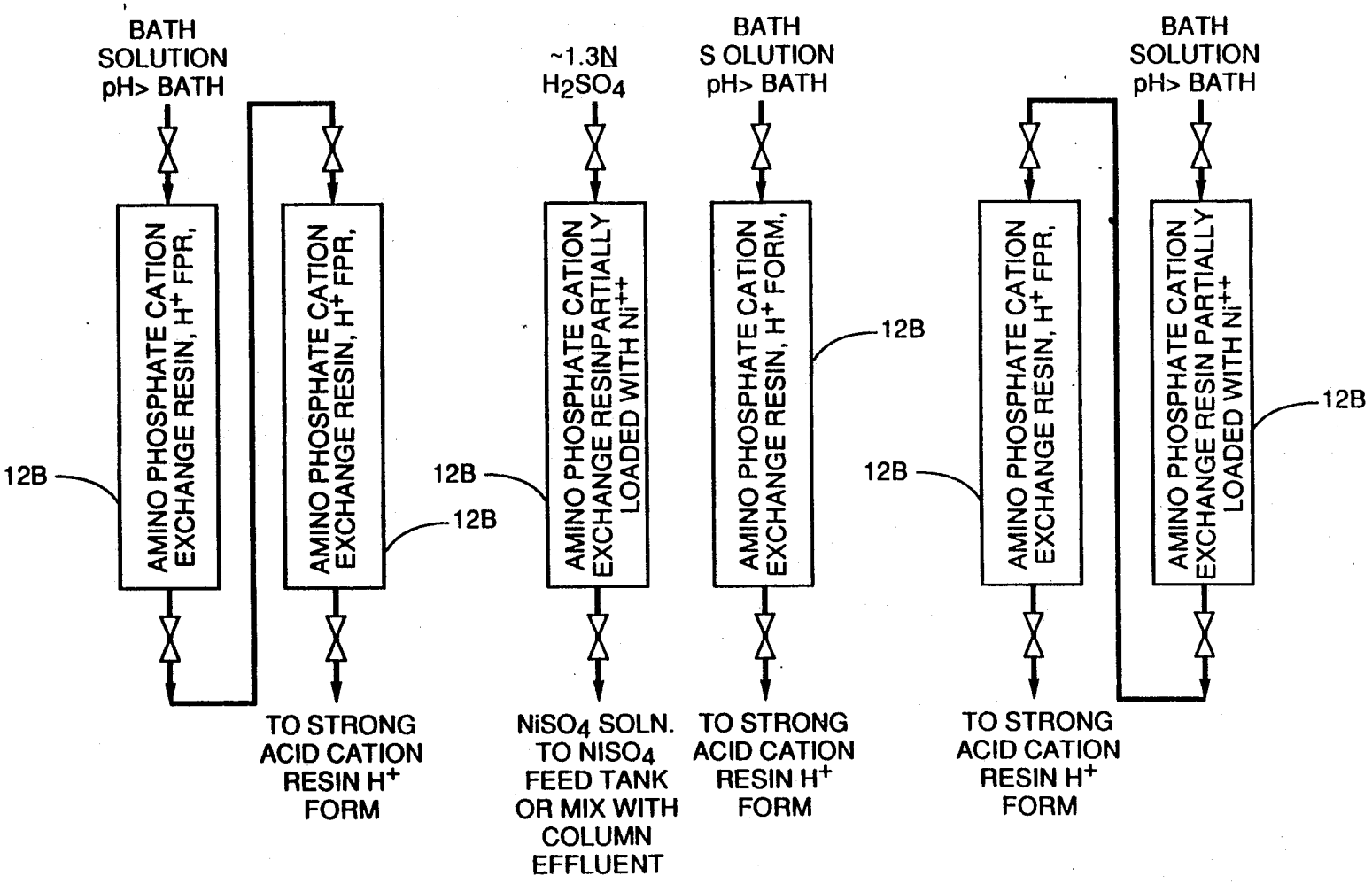
FIG. 7A through 7D are drawings depicting aspects of the removal of Na and Ni cations when an intermediate acid exchanger precedes a strong acid exchanger in the process.

The use of these intermediate acid exchangers, and their regeneration, is illustrated in FIGS. 7A through 7D. In FIG. 7A, for example, the bath solution with the pH adjusted upwardly to about 5.8 to 6.0 to enhance nickel sorption first flows down through unit 12B (see reference thereto in FIG. 1) and then downwardly through unit 12B'. Some loading of the Ni occurs in the first column, but breakthrough occurs into unit 12B'; however essentially all of the nickel present in the bath is retained on the intermediate acid exchanger material with little sorption of sodium. The effluent from 12B' is fed into the strong acid exchangers (preferably two or three units in series) for the sorption of the sodium. The precipitation equipment is further downstream from the strong acid exchanger units. When regeneration is required, one of the units (e.g., 12B) can be taken out of the bath stream and sulfuric acid (typically about 1.3 N) passed therethrough as indicated in FIG. 7B to remove the nickel. During this time the other unit (12B') continues to receive the bath solution as indicated in FIG. 7C. After regeneration of the one unit, the roles of the two units can be switched as indicated in FIG. 7D and the sorption and regeneration continued using the valves shown in these figures. The sodium that would be sorbed on the strong acid exchanger units would be removed as discussed above with regard to FIG. 6.

The process of the present invention was carried out using conventional apparatus. A four inch ID glass pipe was filled with about 9 liters of 8% divinylbenzene cross-linked polystyrene resin having sulfonic acid exchange groups. This exchanger has a sodium ion exchange capacity (at pH 7.0) of 2.068 gram-equivalents/liter; and at a bath pH of 4.55, the exchange capacity is 1.6 gram-equivalents/liter of resin in the hydrogen ion form. The volume of bath solution (typically 4.4 liters) used contained an amount of sodium plus nickel ion gram-equivalents corresponding to about 70% of the resin exchange capacity. The sodium and nickel ions were essentially completely sorbed by the exchange with hydrogen ions, with the sodium being sorbed in an earlier portion of the exchanger and the nickel being absorbed in a narrow band below the sodium. The hydrogen ions were released to the solution. The effluent from the column contained the hypophosphorous, phosphorous, lactic and sulfuric acids, together with the wetting agent and the complexed lead of the bath solution. A wash of the column with distilled water assured a complete removal of these substances.

The acidic effluent was then treated with calcium oxide (typically about 100 g) until the pH began to increase to about 0.9. As the calcium oxide was added, the temperature rose and calcium sulfate hemihydrate was precipitated. Addition of some previously precipitated calcium sulfate hemihydrate as seed crystals resulted in a readily filterable precipitate. The final stage of calcium sulfate precipitation was accomplished by the addition of calcium carbonate (typically about 90 g) as a reagent to avoid a pH overshoot and to enhance the quality of the precipitate. When the pH was between 1.2 and 1.4, the calcium sulfate hemihydrate was removed by filtration, and the cake was washed with enough water to displace all mother liquor.

The filtrate from the calcium sulfate precipitation was then treated with magnesium oxide (typically about 199 g) to precipitate phosphite as magnesium phosphite trihydrate. Precipitation typically began at a pH of about 3.6 to 5.0. After cooling to room temperature, the phosphite remaining in the solution was relatively small. The filtrate from this precipitation contained the constituents needed in the bath solution except for nickel ions. Evaporation was used to decrease the volume by about 35%.

As discussed previously, several alternatives are available for the recovery of the nickel from the cation exchanger. For example, the column was treated with 0.25 N sulfuric acid to displace sodium ions from the cation exchanger. Then the column was treated with about 1.3 mol/l magnesium sulfate to displace nickel from the column as nickel sulfate in a sulfuric acid solution. Feed of the magnesium sulfate was discontinued when the nickel was essentially removed but prior to including any significant amount of the magnesium sulfate in the effluent. This nickel solution was concentrated by evaporation to a Ni level of about 0.4 mol/l. Thereafter, any sulfuric acid was removed by treatment with CaO and $CaCO_3$ as used on the resin column effluent to precipitate calcium sulfate hemihydrate. The filter cake of this precipitate was washed free of nickel sulfate solution with distilled water.

Of course, the other sodium and nickel removal process of FIGS. 2B and 2C can be used.

The concentrated magnesium phosphite, magnesium lactate, and sulfate solutions were then mixed with the concentrated nickel sulfate solution. This combined solution was treated with activated carbon and then filtered to remove any organics from the resin or initial bath. While this treatment and filtration are practical steps for bath treatment, they do not form essential steps to the process. This was followed by an analysis for ingredients, and any needed make-up chemicals were added. If necessary, the final solution was adjusted with distilled water to achieve the desired bath concentration.

The cation exchange resin column was regenerated for future treatment cycles with about 2 mol/l hydrochloric acid or sulfuric acid to convert it to the hydrogen ion form. Acidic column effluents were neutralized in a central neutralization facility to give nontoxic aqueous effluents and solids.

The plating rate using a specific electroless nickel plating bath was increased from 0.29 mils/hr to 0.76 mils/hr with a recovered bath which contained magnesium and a small amount of calcium as the major ions other than nickel. This latter number corresponds to a plating rate of 19.4 micrometers/hr. Good quality electroless nickel plates were obtained without significant inclusion of either magnesium or calcium in the plates. The excellent plating rates and plate quality were somewhat unexpected since calcium ions are generally considered to interfere with electroless nickel plating. Therefore, magnesium can be substituted for sodium ions in electroless nickel baths without deleterious effects.

A multi-column test of the present invention was carried out using four columns of the above-cited strong acid cation exchanger, with three being used for bath processing, and the fourth was a regeneration column.

TABLE 1

| Column No. | Percentage of Nickel and Sodium Retained by Columns: Nickel Retained (%) | Sodium Retained (%) |
|---|---|---|
| 1 | 19.96 | 53.63 |
| 2 | 79.19 | 37.51 |
| 3 | 0.84 | 0.86 |

Cyclic use of the columns is, of course, preferred. After subjecting the effluent from column No. 3 to the precipitation steps (see FIG. 4), the effluent therefrom was passed through the nickel-rich column (No. 2) in the first cycle and this was found to remove essentially 100% of the nickel from the column. the second cycle, column No. 1 becomes the column with the nickel sorption (equivalent to No. 2 in the first cycle). About 94% of the nickel was removed. Similarly, in cycle three, column No. 3 is the column in which the nickel is sorbed. The effluent from the columns was found to be essentially free of any nickel. Sodium in the rejuvenated solution was less than 40% of that in the feed. The sequence of columns in the first five treatment cycles is shown in the following Table 2.

TABLE 2

| Cycle No. | | Column Sequences vs Column Cycles: Column Numbers: First Column | Second Column | Third Column | | Fourth Column |
|---|---|---|---|---|---|---|
| 1 | Electroless Ni Bath | → 1 | → 2 | → 3 | → { ppt. | 4HCl Regen. |
| | Rejuvenated Bath | ← | 2 | ← | pH adj | $MgCl_2$, $CaCl_2$ |
| | Dilute $H_2SO_4$ | → 1 | | → 3 | → | $Na_2SO_4$, $H_2SO_4$ |
| 2 | ENB | → 3 | → 1 | → 4 | → { ppt. | 2HCl Regen. |
| | Rejuvenated ENB | ← | 1 | ← | pH adj | $MgCl_2$, $CaCl_2$ |
| | Dilute $H_2SO_4$ | → 3 | | → 4 | → | $Na_2SO_4$ |
| 3 | ENB | → 4 | → 3 | → 2 | → { ppt. | 1HCl Regen. |
| | Rejuvenated ENB | ← | 3 | ← | pH adj | $MgCl_2$, $CaCl_2$ |
| | Dilute $H_2SO_4$ | → 4 | | → 2 | → | $Na_2SO_4$ |
| 4 | ENB | → 2 | → 4 | → 1 | → { ppt. | 3HCl Regen. |
| | Rejuvenated ENB | ← | 4 | ← | pH adj | $MgCl_2$, $CaCl_2$ |
| | Dilute $H_2SO_4$ | → 2 | | → 1 | → | $Na_2SO_4$ |
| 5 | ENB | → 1 | → 2 | → 3 | → { ppt. | 4HCl Regen. |
| | Rejuvenated ENB | ← | 2 | ← | pH adj | $MgCl_2$, $CaCl_2$ |
| | Dilute $H_2SO_4$ | → 1 | | → 3 | → | $Na_2SO_4$ |

The columns were designated as No. 1, No. 2 and No. 3 and initially contained neither nickel or sodium ions. The three columns were treated in succession by upflow of electroless nickel bath solution (as generally indicated in FIG. 3). Upflow is preferred since this decreases mixing of solution in the columns due to density gradients when flows are stopped for a period of time. Flow was continued until the nickel band approached the outlet from column No. 2. The percentages of the nickel and sodium fed to the columns which were retained in each column are shown in the following Table 1.

From the foregoing, it will be understood by one skilled in the art that a process has the treatment of electroless nickel baths (as well as other electroless plating baths) to remove deleterious materials that will therwise degrade plating operations. It can be used to recover the nickel (or other plating metal) in addition to providing material to recycle to the bath. The process can be used to periodically achieve purification, or can be used to continuously process a small side stream from the bath. The products of the process that are not reusable for the bath are in a form such that they can easily be disposed of in nonhazardous landfills, for use in fertilizer and other such applications.

The process has been described for use with sulfate-containing baths. Since calcium and magnesium borates have low solubility, the present process of cation exchange and precipitation could be used with baths containing boron compounds as reducing agents. Further, the process can be extended to treatment of electrolytic baths and treatment solutions where chemicals accumulate which can be converted to their respective acids and precipitated with alkaline compounds.

Although specific concentrations are discussed hereinabove in describing a typical utilization of the present process, these are not given as limitations. Rather, the present process is to be limited only by the claims appended hereto or equivalents thereof.

We claim:

1. A process for the removal of deleterious contaminants from a used electroless metal plating bath solution containing at least plating metal ions and sodium ions in sulfate form to recover said plating ions and to permit reuse of said solution at a selected pH, the process comprising the steps:

passing at least a portion of said used bath solution through an acid cation exchanger in hydrogen form, said acid cation exchanger selected from the group consisting of strong acid exchangers and a combination of intermediate acid and strong acid exchangers, to remove said sodium ions and said plating metal ions by exchange with hydrogen ions of said cation exchanger and to convert sulfate, phosphites and non-sorbed constituents in said at least portion of said used bath solution to their respective acids in an effluent from said exchanger;

adding a basic calcium salt to said effluent from said exchanger to precipitate from said effluent calcium sulfate hemihydrate;

removing said precipitated calcium sulfate hemihydrate to produce a liquid phase;

recovering said liquid phase from said precipitation of said calcium sulfate hemihydrate;

adding a basic magnesium salt to said liquid phase from said precipitation of said calcium sulfate hemihydrate to precipitate magnesium phosphite trihydrate;

removing said precipitated magnesium phosphite trihydrate to produce a magnesium sulfate liquid phase;

recovering said magnesium sulfate liquid phase from said precipitation of said magnesium phosphite trihydrate; and eluting said plating metal ions from said cation exchanger.

2. The process of claim 1 further comprising the steps:

adjusting said magnesium sulfate liquid phase recovered from said precipitation of said magnesium phosphite trihydrate to said selected pH of an electroless bath solution for reuse; and adding said plating metal ions eluted from said cation exchanger to said pH adjusted magnesium sulfate liquid phase from said precipitation of said magnesium phosphite trihydrate.

3. The process of claim 1 wherein said exchanger is a strong acid cation exchanger having sulfonic acid functional groups.

4. The process of claim 3 wherein said plating metal ions are nickel ions and said eluting said nickel ions from said cation exchanger comprises the step of passing said magnesium sulfate liquid phase derived from said magnesium phosphite trihydrate precipitation step through said strong acid cation exchanger to remove said nickel ions as nickel sulfate.

5. The process of claim 1 wherein said exchanger is an intermediate acid cation exchanger in phosphonic acid form followed by a strong acid cation exchanger having sulfonic acid functional groups whereby metal plating ions are retained on said intermediate acid cation exchanger and said sodium ions are retained on said strong acid cation exchanger.

6. The process of claim 5 wherein said plating metal ions nickel ions and said step of eluting nickel ions comprises the step of passing about 1.3 N sulfuric acid through said intermediate acid exchanger to remove said nickel ions as nickel sulfate.

7. The process of claim 1 wherein said basic calcium salt is selected from the group consisting of CaO, $CaCO_3$, $Ca(OH)_2$ and mixtures thereof.

8. The process of claim 7 wherein said basic calcium salt comprises sequential additions of said CaO and $CaCO_3$, said CaO being added prior to said $CaCO_3$.

9. The process of claim 1 wherein said basic magnesium salt is selected from the group consisting of MgO and $Mg(OH)_2$.

10. The process of claim 9 wherein said basic magnesium salt is MgO and wherein said precipitation step with said basic magnesium salt is carried out at about 20° to about 25° C.

11. The process of claim 1 further comprising the steps:

cooling said at least a portion of said used bath solution to about 25° C. prior to being passed through said acid cation exchanger; and heating said electroless bath solution for reuse to about 95° C.

12. The process of claim 1 wherein said plating metal ions are nickel ions and said cation exchanger is a strong acid cation exchanger having sulfonic acid functional groups, and said step of eluting said nickel ions from said cation exchanger comprises the steps:

passing a dilute solution of about 0.25 mol/l sulfuric acid through said cation exchanger to remove sodium ions as sodium sulfate; and passing a more concentrated solution of about 2 to about 2.5 mol/l sulfuric acid through said cation exchanger, after removal of said sodium ions, to remove said nickel ions as nickel sulfate.

13. A process for the removal of deleterious contaminants from a used electroless nickel solution to permit reuse of said solution at a selected pH of about 4.5, which comprises the steps:

passing at least a portion of said used solution through a strong acid cation exchanger in hydrogen form having sulfonic acid functional groups to remove sodium ions and nickel ions by exchange with hydrogen ions and to convert sulfates, phosphites and non-sorbed constituents in said at least portion of said used bath solution to their respective acids in an effluent from said exchanger;

adding a basic calcium salt selected from the group consisting of CaO, $CaCO_3$ and mixtures thereof to said effluent from said exchanger to precipitate calcium sulfate hemihydrate from said effluent;

removing said precipitated calcium sulfate hemihydrate by filtration to produce a filtrate;

recovering said filtrate from said precipitation of said calcium sulfate hemihydrate;

adding a basic magnesium salt selected from the group consisting of MgO and $Mg(OH)_2$ to said filtrate from said precipitation of said calcium sulfate hemihydrate to precipitate magnesium phosphite trihydrate;

removing said precipitated magnesium phosphite trihydrate by filtration to produce a filtrate;

recovering said filtrate from said precipitation of said magnesium phosphite trihydrate;

adjusting said filtrate from said precipitation of said magnesium phosphite trihydrate to said selected pH of about 4.5 for reuse as an electroless nickel bath solution;

eluting said nickel ions from said cation exchanger; and adding said eluted nickel ions from said cation exchanger to said pH adjusted filtrate from said precipitation of said magnesium phosphite trihydrate.

14. The process of claim 13 wherein said basic calcium salt comprises sequential additions of said CaO and $CaO_3$, said CaO being added prior to said $CaCO_3$.

15. The process of claim 13 wherein said basic magnesium salt is MgO and wherein said precipitation step with said basic magnesium salt is carried out at about 20° to about 25° C.

16. The process of claim 13 further comprising the steps:

cooling said at least a portion of said used bath solution to about 25° C. prior to being passed through said strong acid cation exchanger; and heating said electroless nickel bath solution for reuse to about 95° C.

17. The process of claim 13 wherein said step of eluting said nickel ions comprises the steps:

passing a dilute solution of about 0.25 mol/l sulfuric acid through said cation exchanger to remove sodium ions as sodium sulfate; and passing a more concentrated solution of about 2 mol/l sulfuric acid through said cation exchanger after removal of said sodium ions to remove said nickel ions as nickel sulfate.

18. The process of claim 13 wherein said eluting of said nickel ions comprises the step of passing a magnesium sulfate solution through said cation exchanger to remove said nickel ions as nickel sulfate.

19. A process for the removal of deleterious contaminants from a used electroless nickel plating solution and the preparation of an electroless nickel plating solution for reused, said used solution having nickel ions, sodium ions and selected constituents to enhance plating, which comprises the steps:

passing at least a portion of said used bath solution through an intermediate acid cation exchanger in phosphonic acid form to remove said nickel ions by exchange with hydrogen ions;

passing said at least a portion of said used bath solution, after removing said nickel ions in said intermediate acid cation exchanger, through a strong acid cation exchanger in hydrogen form having sulfonic acid functional groups to remove said sodium ions by exchange with hydrogen ions and to convert sulfates, phosphites and non-sorbed constituents in said at least portion of said used bath solution to their respective acids in an effluent from said strong acid cation exchanger;

adding a basic calcium salt selected from the group consisting of CaO, $CaO_3$ and mixtures thereof to said effluent from said strong acid cation exchanger to precipitate calcium sulfate hemihydrate from said effluent;

removing said precipitated calcium sulfate hemihydrate by filtration to produce a filtrate;

recovering said filtrate from said precipitation of said calcium sulfate hemihydrate;

adding MgO to said filtrate from said precipitation of said calcium sulfate hemihydrate to precipitate magnesium phosphite trihydrate;

removing said precipitated magnesium phosphite trihydrate by filtration to produce a filtrate;

recovering said filtrate from said precipitation of said magnesium phosphite trihydrate;

adjusting said filtrate from said precipitation of said magnesium phosphite trihydrate to a pH of about 4.5;

eluting said nickel ions from said intermediate acid cation exchanger with sulfuric acid of about 1.3 N;

eluting said sodium ions from said strong acid cation exchanger with sulfuric acid of about 0.25 N;

adding said eluted nickel ions from said intermediate acid cation exchanger to said pH adjusted filtrate from said precipitation of said magnesium phosphite trihydrate; and adjusting concentrations of said nickel ions and said selected constituents after adding said eluted nickel ions to said pH adjusted filtrate for preparing said electroless nickel bath solution for reuse.

20. The process of claim 19 further comprising the step of regenerating said intermediate and strong acid cation exchangers to hydrogen form, after elution of said nickel ions and said sodium ions, respectively, with an acid selected from the group consisting of hydrochloric acid and nitric acid.

* * * * *